US006568921B2

(12) United States Patent
Dittrich

(10) Patent No.: US 6,568,921 B2
(45) Date of Patent: May 27, 2003

(54) REFRIGERANT COMPRESSOR

(75) Inventor: Guenter Dittrich, Oschatz (DE)

(73) Assignee: Bitzer Kuehlmaschinenbau GmbH, Sindelfingen (DE)

( * ) Notice: Subject to any disclaimer, the term of this patent is extended or adjusted under 35 U.S.C. 154(b) by 0 days.

(21) Appl. No.: 09/964,255

(22) Filed: Sep. 25, 2001

(65) Prior Publication Data

US 2002/0062657 A1 May 30, 2002

Related U.S. Application Data

(63) Continuation of application No. PCT/EP01/00783, filed on Jan. 25, 2001.

(30) Foreign Application Priority Data

Jan. 29, 2000 (DE) ..... 100 03 882

(51) Int. Cl.[7] ..... F04B 39/00
(52) U.S. Cl. ..... 417/312; 417/269
(58) Field of Search ..... 417/312, 415, 417/533, 269, 540; 181/272

(56) References Cited

U.S. PATENT DOCUMENTS

| | | | | | |
|---|---|---|---|---|---|
| 3,876,339 | A | * | 4/1975 | Gannaway | 417/312 |
| 4,470,772 | A | * | 9/1984 | Gannaway | 417/368 |
| 5,080,130 | A | * | 1/1992 | Terwilliger et al. | 137/512 |
| 5,164,552 | A | * | 11/1992 | Pandeya et al. | 181/249 |
| 5,173,034 | A | | 12/1992 | Riffe | |
| 5,203,857 | A | * | 4/1993 | Terwilliger et al. | 417/552 |
| 5,236,312 | A | | 8/1993 | Finn et al. | |
| 5,238,370 | A | * | 8/1993 | DiFlora | 417/312 |
| 5,326,231 | A | * | 7/1994 | Pandeya et al. | 417/271 |
| 5,542,824 | A | * | 8/1996 | Lee | 417/312 |
| 5,556,260 | A | * | 9/1996 | Takenaka et al. | 417/269 |
| 5,775,885 | A | * | 7/1998 | Dreiman et al. | 417/553 |
| 5,997,258 | A | * | 12/1999 | Sawyer et al. | 417/312 |
| 6,092,993 | A | * | 7/2000 | Young et al. | 417/53 |
| 6,129,522 | A | * | 10/2000 | Seo | 417/312 |
| 6,189,335 | B1 | * | 2/2001 | Ebara et al. | 62/510 |
| 6,389,823 | B1 | * | 5/2002 | Loprete et al. | 62/89 |
| 6,402,483 | B1 | * | 6/2002 | Kawamura et al. | 417/269 |
| 6,402,484 | B1 | * | 6/2002 | Svendsen et al. | 417/312 |

FOREIGN PATENT DOCUMENTS

| | | |
|---|---|---|
| DE | 1 816 816 | 8/1960 |
| DE | 1107884 | 5/1961 |
| DE | 42 19 550 | 1/1993 |
| EP | 0 551 713 | 7/1993 |
| EP | 0 926 343 | 6/1999 |
| FR | 1285014 | 7/1962 |

* cited by examiner

*Primary Examiner*—Teresa Walberg
*Assistant Examiner*—Vinod D Patel
(74) *Attorney, Agent, or Firm*—Barry R. Lipsitz; Douglas M. McAllister

(57) ABSTRACT

To further optimize a refrigerant compressor, comprising a compressor housing, at least one cylinder chamber arranged in the compressor housing, a piston oscillatingly movable in the cylinder chamber, a suction chamber which is arranged upstream from the cylinder chamber and from which refrigerant enters the cylinder chamber, a pressure chamber which is arranged downstream from the cylinder chamber and into which refrigerant compressed in the cylinder chamber enters, a muffler channel which extends between a first end and a second end and via which compressed refrigerant flows from the pressure chamber into the outlet channel, with respect to the space requirement and the attenuation of pulsations, it is proposed that the muffler channel comprise an inlet opening located between the first end and the second end.

21 Claims, 5 Drawing Sheets

REFRIGERANT COMPRESSOR

The present disclosure relates to the subject matter disclosed in international application No. PCT/EP01/00783 of Jan. 25, 2001, which is incorporated herein by reference in its entirety and for all purposes.

BACKGROUND OF THE INVENTION

The invention relates to a refrigerant compressor comprising a compressor housing, at least one cylinder chamber arranged in the compressor housing, a piston oscillatingly movable in the cylinder chamber, a suction chamber which is arranged upstream from the cylinder chamber and from which refrigerant enters the cylinder chamber, a pressure chamber which is arranged downstream from the cylinder chamber and into which refrigerant compressed in the cylinder chamber enters, a muffler channel which extends between a first end and a second end and via which compressed refrigerant flows from the pressure chamber into a outlet channel.

Such a refrigerant compressor is known, for example, from EP 0 926 343.

In this refrigerant compressor, refrigerant flows through the entire muffler channel in one direction, and a satisfactory attenuation is achieved, but there is a considerable space requirement owing to the length of the muffler channel through which the refrigerant flows.

The object underlying the invention is to further optimize such a refrigerant compressor with respect to the space requirement and the attenuation of pulsations.

SUMMARY OF THE INVENTION

This object is accomplished in a refrigerant compressor of the kind described at the outset, in accordance with the invention, in that the muffler channel comprises an inlet opening located between the first end and the second end.

The inventive solution makes it possible to further optimize the attenuation of pulsations in refrigerant compressors, namely by a pressure wave which enters the muffler channel propagating from the inlet opening in the direction of both the first and the second end and by the attenuation of pulsations then being even better due to reflections at both ends of the muffler channel.

Furthermore, optimum arrangement of such a muffler channel with respect to space is possible.

The outlet opening can, in principle, be arranged at very different places on the muffler channel. A particularly expedient solution makes provision for the outlet opening to be located in the area of one of the ends so that compressed refrigerant flows through the muffler channel insofar as it is conducted from the inlet opening to the outlet opening in the area of one of the ends.

In a particularly expedient solution to the realization of the muffler channel with respect to the provision of outlet openings, provision is made for the muffler channel to comprise two orifices in addition to the inlet opening, and for at least one of the orifices to form the outlet opening. This solution can be realized in a particularly simple way from a constructional point of view, in particular, also when the orifices are arranged in the area of opposite ends.

Many different possibilities of employing the inventive muffler channel are conceivable. One possibility is to so design the muffler channel that the compressed refrigerant flows into the muffler channel through the inlet opening and then in the direction of both ends to the respective outlet openings.

As an alternative or supplement to the above solution, a solution which is particularly expedient, in particular, with respect to its attenuating effect makes provision for the muffler channel extending between the ends to comprise a section through which the compressed refrigerant flows, and a section which is closed off in an acoustically blind manner, i.e., a section with reflection at the acoustically closed end. In particular, the section of the muffler channel closed off in an acoustically blind manner makes a considerable contribution towards the attenuation of pulsations or pressure waves because a reflection of a pressure wave occurs therein which then becomes superimposed with pressure waves subsequently entering the muffler channel through the inlet opening.

In particular, an acoustically blind section is designed such that an opening or a gap is created through which oil can flow off and so accumulations of oil are avoided.

Many different possibilities are conceivable for arranging the two sections relative to each other. For example, it is conceivable for the section of the muffler channel which is closed off in an acoustically blind manner to adjoin the outlet opening, so that a pressure wave entering the muffler channel first travels from the inlet opening to the outlet opening and then a portion thereof does not leave the muffler channel through the outlet opening but starting from the outlet opening propagates further in the section closed off in an acoustically blind manner.

A solution which is even more advantageous with respect to the attenuating effect makes provision for the section of the muffler channel through which the refrigerant flows and the section of the muffler channel which is closed off in an acoustically blind manner to extend away from the inlet opening, so that the pressure wave entering the muffler channel through the inlet opening is divided up into the section closed off in an acoustically blind manner and the section through which the refrigerant flows.

It is particularly expedient for the section through which the refrigerant flows and the section which is closed off in an acoustically blind manner to extend away from the inlet opening in opposite directions, so that, in particular, reflections in the section closed off in an acoustically blind manner can directly propagate further into the section through which the refrigerant flows.

So far no details have been given about the position of the inlet opening. In principle, it is conceivable to provide the inlet opening at optional places between the first end and the second end. A particularly expedient solution makes provision for the inlet opening to be located in the area of a central section of the muffler channel, preferably in the area of approximately half the entire length of the muffler channel, so that an incoming pressure wave separates into two sections which in their order of magnitude are of approximately equal length.

No details of the concrete embodiment of the muffler channel have been given in conjunction with the preceding embodiments. In an advantageous embodiment, provision is made for the muffler channel to be arranged in a part which is mountable on the compressor housing, and for the part to be mountable on the compressor housing in such a way that either the orifice arranged at the first end or the orifice arranged at the second end serves as outlet opening and leads into the outlet channel which is, for example, provided in the compressor housing.

As regards the respective other orifice, it is, for example, conceivable for it to lead into an additional section of the muffler channel extending, for example, in the compressor housing, and ending somewhere in an acoustically blind manner in the compressor housing. This would open up the possibility of additionally lengthening the muffler channel by a further section.

It is, however, particularly expedient from a constructional point of view for the respective orifice not opening into the outlet channel provided to be closed off in an acoustically blind manner.

Such an acoustically blind closure of the orifice could, for example, be brought about by a plug which is inserted or screwed in.

It is, however, particularly expedient for the orifice to be closed by an area of the part which carries the part mountable on the compressor housing.

In the simplest case, the part mountable on the compressor housing is the valve plate which is carried by a crankcase of the compressor housing and closes off the orifice with an area which covers it.

No details of the part which comprises the muffler channel and is mountable on the compressor housing have been given. This could be a separate part which is completely independent of the usual parts of the compressor housing and is inserted as a separate insert, for example, when assembling the cylinder head.

However, it is particularly expedient for the muffler channel to extend in the cylinder head and for the cylinder head to thus form the part which comprises the muffler channel and is mountable on the compressor housing.

An element forming the muffler channel, for example, a muffler pipe, can likewise be inserted in the cylinder head. It is, however, particularly advantageous for the muffler channel to be formed in the cylinder head, i.e., for example, when the cylinder head is in the form of a cast part the muffler channel is then provided in this cast part. Alternatively, it is, however, also conceivable to realize the muffler channel as a bore provided in the cylinder head.

Nor have any details of the configuration of the muffler channel in the cylinder head so far been given.

A solution which is particularly advantageous as far as the saving of space is concerned makes provision for the muffler channel to extend with one section thereof in a surface lying approximately parallel to a cylinder head cover of the cylinder head, i.e., the muffler channel which for the attenuation of pulsations with certain frequency components has preferably to have a corresponding length, can advantageously have a sufficient length by extending in this surface, without the cylinder head thereby being of considerably larger construction.

Furthermore, provision is preferably made for the muffler channel to extend with a substantial section thereof in the direction of a crankshaft and to thus preferably also extend in the direction in which the cylinders are arranged following one another in a multicylinder refrigerant compressor.

Nor have any details been given regarding the arrangement of the muffler channel relative to the pressure chamber. A particularly expedient solution makes provision for the muffler channel to extend on a side of the pressure chamber facing away from the cylinder chambers as it is, for example, thus possible to allow the muffler channel to extend along the cylinder head cover, with it being, for example, formed thereon or therein.

To obtain a suitable position for the orifices of the muffler channel, provision is preferably made for the muffler channel to have end areas extending in the direction of a crankcase so that these end areas can then be provided in a simple way with orifices which are accessible in the area of the crankcase, preferably accessible via the crankcase.

For example, the orifices of the muffler channel are located so as to face the crankcase. A particularly expedient solution makes provision for the orifices of the muffler channel to lie in a bearing surface of the cylinder head, and, thus, also sealing in the area of the orifices can be realized in a simple way, for example, by placing the cylinder head on the remaining compressor housing.

It is particularly expedient for the orifices to be sealed off in the same way as the cylinder head in the area of its bearing surface.

To achieve as good reflection and decoupling as possible at the outlet opening and the inlet opening, respectively, provision is preferably made for the inlet opening of the muffler channel to open with an abrupt cross-sectional change into the pressure chamber and for the outlet opening of the muffler channel to open with an abrupt cross-sectional change into the outlet channel.

The abrupt cross-sectional changes are preferably of such size that the abrupt cross-sectional change between the muffler channel and the outlet channel is at least by a factor 2 or 3, and, in this case, an abrupt cross-sectional change occurs from a small cross section, namely that of the outlet opening, to a large cross section, namely that of the outlet channel.

It is even better for the abrupt cross-sectional change to be at least by a factor 5.

Furthermore, the decoupling between the muffler channel and the pressure chamber is likewise promoted by the abrupt cross-sectional change between the muffler channel and the pressure chamber being by at least a factor 3, even better by a factor 5, and, in this case, an abrupt cross-sectional change occurs from the large cross section of the pressure chamber to a cross section which is smaller by the factor 3 or 5, namely that of the inlet opening of the muffler channel.

It is even better for this abrupt cross-sectional change to also be greater.

No further details of the type of the muffler channel have been given in the above explanation of the individual embodiments. It is, for example, conceivable to design the muffler channel as a channel with a constant cross section.

As an alternative or supplement thereto, it is, however, also conceivable to provide the muffler channel with cross-sectional constrictions, for example, produced by screens, in order to further increase the attenuating effect, so that the muffler channel has different cross sections at different places in the longitudinal direction thereof.

The cross-sectional constrictions and the cross-sectional expansions can be arranged in each section of the muffler channel, for example, in the section through which the refrigerant flows or in the section which is closed off in an acoustically blind manner.

It is, however, also conceivable to provide the cross-sectional constrictions and cross-sectional expansions in both of these sections.

It is particularly advantageous for the cross-sectional constrictions and cross-sectional expansions to be arranged symmetrically in relation to the inlet opening.

Further features and advantages of the invention are the subject of the following description and the appended drawings of an embodiment.

Figure 1:
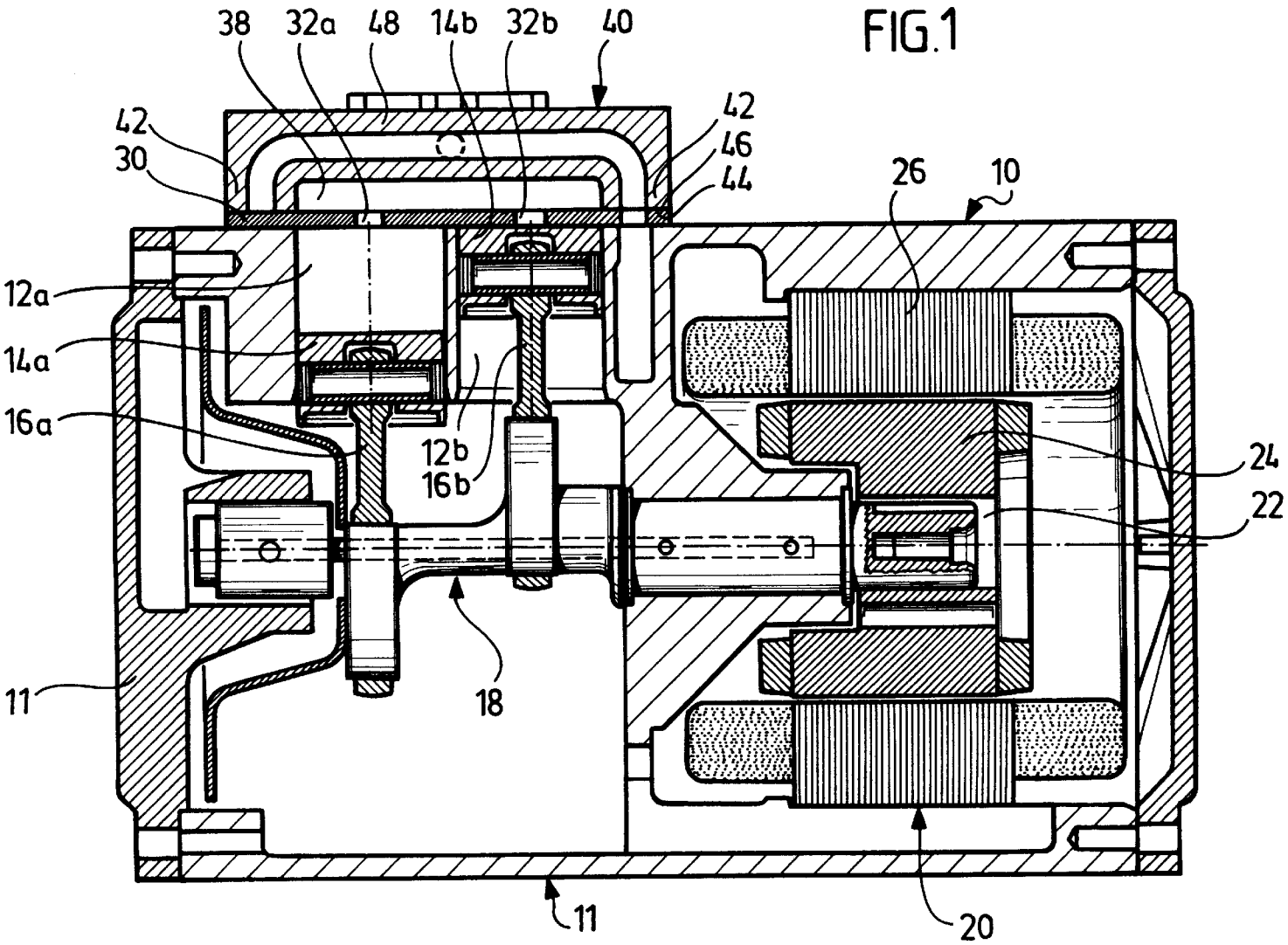
FIG. 1 is a longitudinal section through a first embodiment of an inventive refrigerant compressor in the area of two cylinder chambers.
Figure 2:
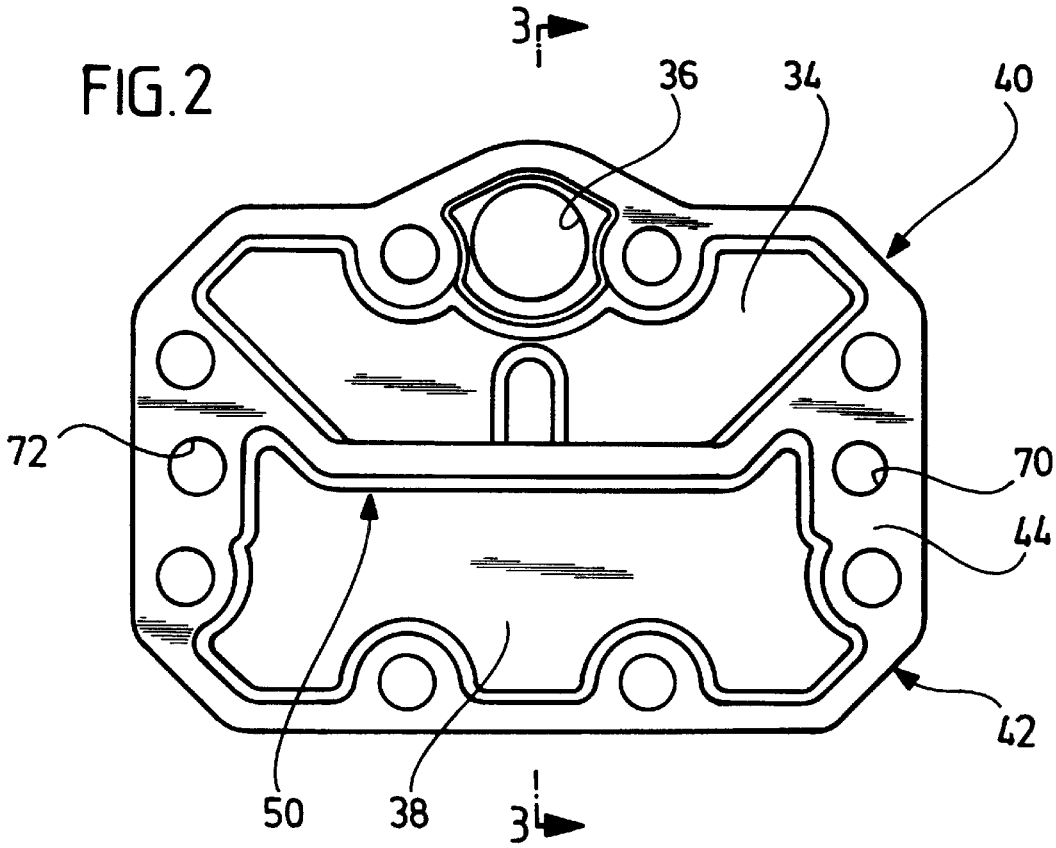
FIG. 2 is a section taken along line 2—2 in FIG. 1.
Figure 3:
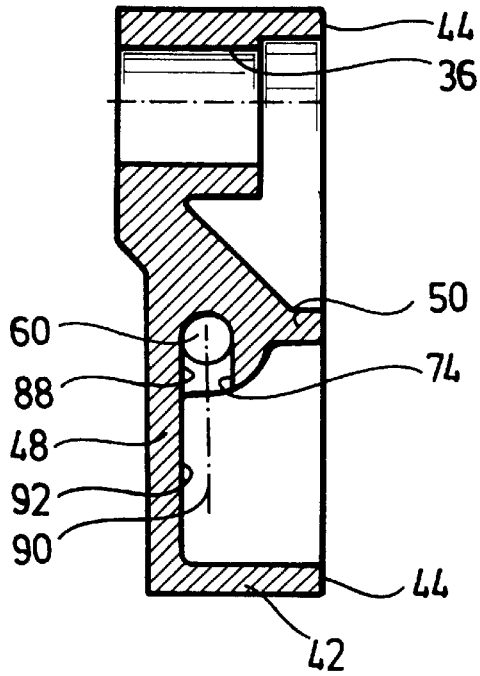
FIG. 3 is a section taken along line 3—3 in FIG. 2.

A first embodiment of an inventive refrigerant compressor, shown in FIGS. 1 to 5, comprises a compressor housing generally designated 10, with a crankcase 11 in which two cylinder chambers 12*a* and 12*b* are arranged. Oscillatingly movable in the cylinder chambers 12*a* and 12*b* are pistons 14*a*, 14*b*, which interact via connecting rods 16*a*, 16*b* with a crankshaft 18 which is arranged in the crankcase 11.

The crankshaft 18 is driven, for example, by an electric motor 20 whose motor shaft 22 is arranged coaxially with the crankshaft 18 and carries a rotor 24 which is surrounded by a stator 26 which, in turn, is arranged stationarily in the compressor housing 10.

The cylinder chambers 12*a* and 12*b* are closed off at their head end by a valve plate 30 resting on the crankcase 11 and having both intake valves and discharge valves 32*a* and 32*b*.

A cylinder head generally designated 40 is seated on a side of the valve plate 30 located opposite the crankcase 11. Together with the valve plate 30, the cylinder head 40 encloses, on the one hand, a suction chamber 34, which lies over the intake openings and into which refrigerant to be compressed flows via a suction channel 36, and, on the other hand, a pressure chamber 38, which lies over the discharge valves 32*a* and 32*b*, so that compressed refrigerant enters the pressure chamber 38 from the cylinder chambers 12*a* and 12*b* via the discharge valves 32*a* and 32*b*.

The cylinder head 40 preferably has an outer wall area 42 which rests with a bearing surface 44 on a supporting surface 46 formed by the valve plate 30, and a cylinder head cover 48 which extends over the space enclosed by the outer wall area 42 and comprising the suction chamber 34 and the pressure chamber 38, and approximately parallel to the valve plate 30, so as to close off the suction chamber 34 and the pressure chamber 38 on the side located opposite the valve plate 30.

The cylinder head 40 further comprises a dividing wall 50, which also extends from the valve plate 30 to the cylinder head cover 58 so as to separate the suction chamber 34 and the pressure chamber 38 from each other.

As shown in FIGS. 1 to 4, a muffler channel generally designated 60 is formed in the cylinder head 40, more specifically, in the area of the dividing wall 50 and close to the cylinder head cover 48. With a central section 62, the muffler channel 60 extends parallel to the cylinder head cover 48, and with end sections 64, 66 it extends in curved configuration into the area of the outer walls 42 and has in the area of the first end section 64 a first orifice 70 and in the area of the second end section 66 a second orifice 72, which preferably lie in the plane of the bearing surface 44.

Also provided is an inlet opening 74, which opens into the central section 62 of the muffler channel 60.

Figure 4:
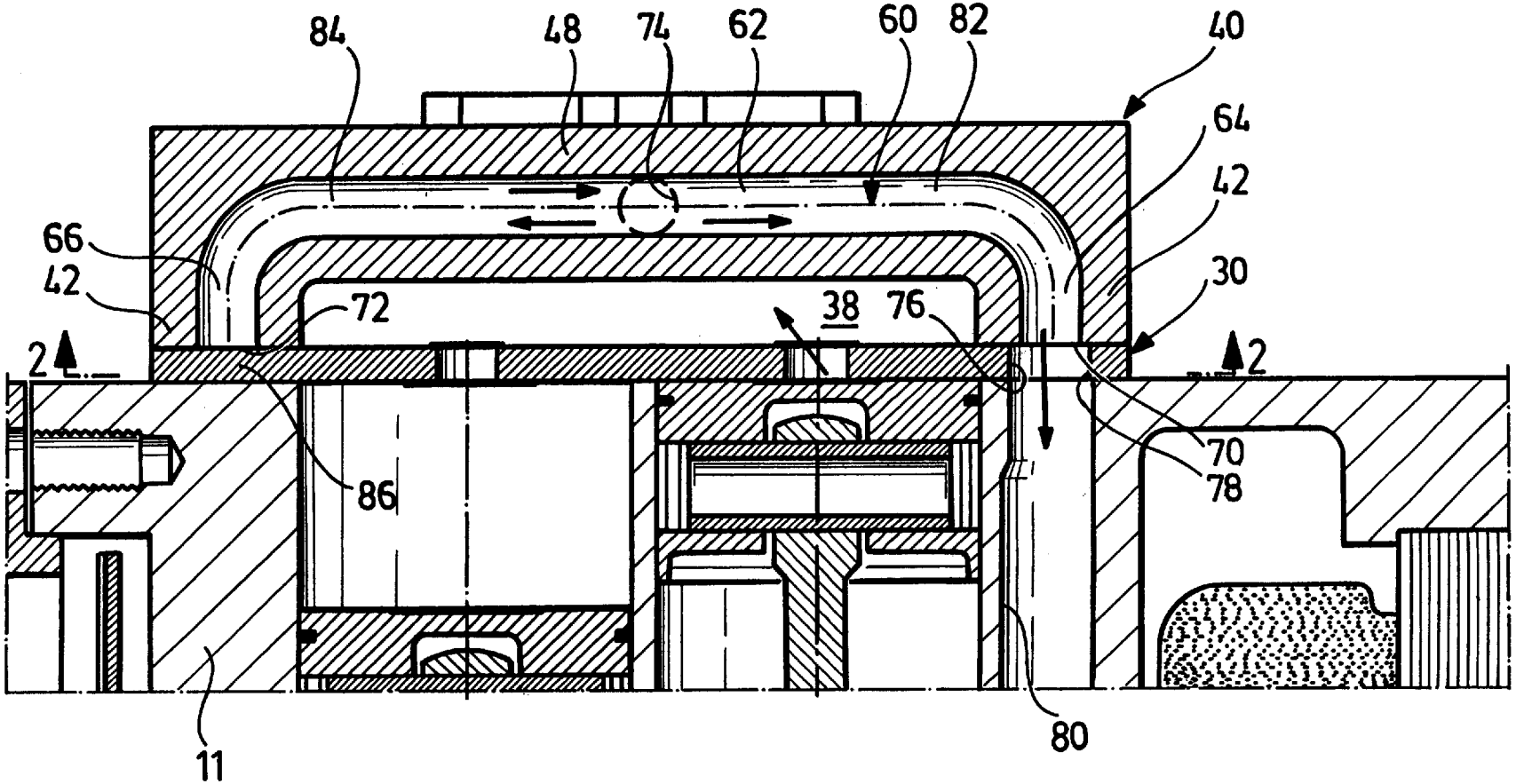
FIG. 4 is an enlarged representation of the section according to FIG. 1 in the area of the cylinder head.

As shown in FIGS. 1 and 4, in a first type of installation of the cylinder head 40 the latter rests on the valve plate 30 in such a way that a through-opening 76 provided in the valve plate 30 is arranged in alignment with the first orifice 70 and, furthermore, lies over an inlet opening 78 of an outlet channel generally designated 80, which is guided in the crankcase 11. The compressed refrigerant entering the pressure chamber 38 first flows via the inlet opening 74 into the muffler channel 60 and flows through the latter but only in the area of its section 82 extending from the inlet opening 74 to the first orifice 70. It does, however, not flow through a section 84 lying between the inlet opening 74 and the second orifice 72 because the second orifice 72 is closed off in an acoustically blind manner by an area 86 of the valve plate 30.

The section 84 thus serves as so-called "blind section" of the muffler channel 60.

However, both the section 82 of the muffler channel 60 through which the compressed refrigerant flows and the section 84 of the muffler channel 60 through which it does not flow contribute to the attenuation effect of the muffler channel 60 because the pulsations or pressure waves entering through the inlet opening 74 propagate in both directions along the sections 82 and 84. A reflection does, however, occur at the closed end in the end area 66 closed off in an acoustically blind manner by the area 86 of the valve plate 30, and the returning pressure waves then again become superimposed with the pressure waves continuing to enter through the inlet opening 74. Also, a partial reflection occurs at the first orifice 70 in the form of a reflection at the open end so that the likewise returning pressure waves again become superimposed with the pressure waves entering through the inlet opening 74, and, all in all, an advantageous attenuation effect of the muffler channel 60 occurs.

The reflection in the area of the orifice 70 is caused by an abrupt cross-sectional change at the transition from the orifice 70 to the outlet channel 80, and this abrupt cross-sectional change is at least by a factor 3 in relation to the cross section that is effective for the compressed refrigerant flowing out.

An abrupt cross-sectional change by at least a factor 3, even better a factor 5 or more, is preferably also provided in the area of the inlet opening 74.

A further special advantage of the muffler channel 60, whose relevant length for the attenuation effect is made up of the length of the sections 82 and 84, is that the exiting compressed refrigerant only flows through the section 82, and, therefore, the pressure loss occurring due to this is lower than in the case where the compressed refrigerant flows through the entire muffler channel 60.

The attenuating effect of the muffler channel 60 is further improved by the inlet opening 74 being located close to the cylinder head cover 48 and preferably being formed by a channel section 88 whose longitudinal axis 90 does not directly face the discharge valves 32*a* and 32*b*, so that the pulsation or pressure wave is first deflected at the inner side 92 of the cylinder head cover before it can enter the muffler channel 60.

Furthermore, an advantageous effect of the muffler channel 60 is also achievable by the inlet opening 74 being positioned such that it can be arranged at almost identical distances from the two discharge valves 32*a* and 32*b*.

Figure 5:
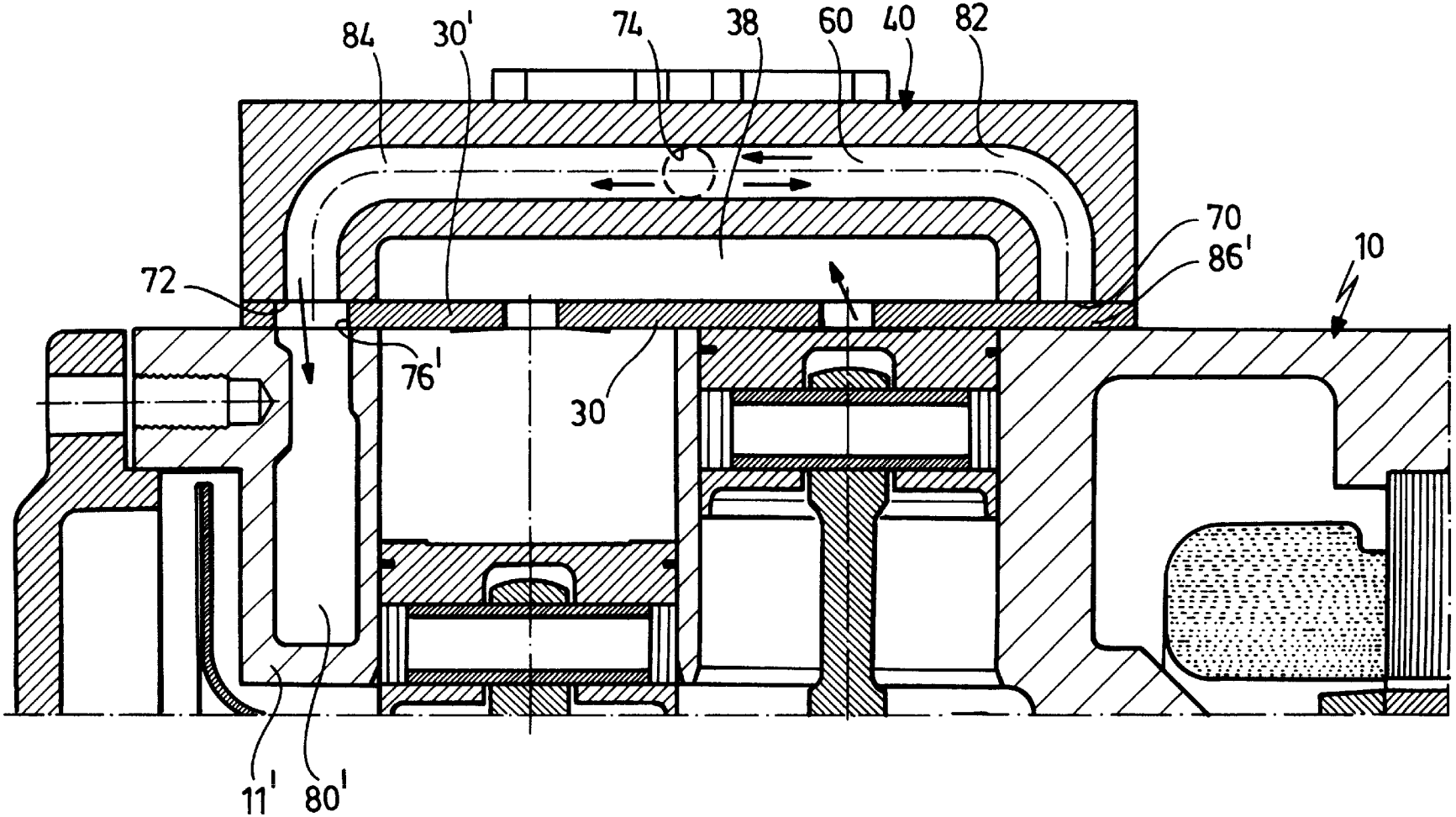
FIG. 5 is a section similar to FIG. 4 through an area of the inventive refrigerant compressor having two other cylinder chambers.

As shown in FIG. 5, the inventive solution has the further advantage that the same inventive cylinder head 40 can be used for a crankcase 11' in which the outlet channel 80' is arranged such that the compressed refrigerant can enter it through the second orifice 72 and, consequently, the valve plate 30' has a through-opening 76', whereas, on the other hand, the valve plate 30' has an area 86' which closes off the first orifice 70 of the muffler channel 60. The muffler channel 60 operates in the same way, but, in this case, the compressed refrigerant flows through the second section 84, while the section 82 represents the so-called "blind section" of the muffler channel 60.

With such a cylinder head 40, a four-cylinder refrigerant compressor is preferably manufacturable, wherein with two cylinder chambers 12*a* and 12*b* arranged on one side of the compressor housing 10, the corresponding crankcase 11 has the shape shown in FIGS. 1 and 4, and compressed refrigerant flows into the outlet channel 80 via the first orifice 70, whereas the corresponding crankcase 11' in which the outlet channel 80' is arranged such that compressed refrigerant flows into it via the second orifice 72 is provided on the other side of the compressor housing 10.

Thus the inventive cylinder head can be used as an identical part in different crankcases 11, 11' with differently located outlet channels 80 and 80'.

Figure 6:
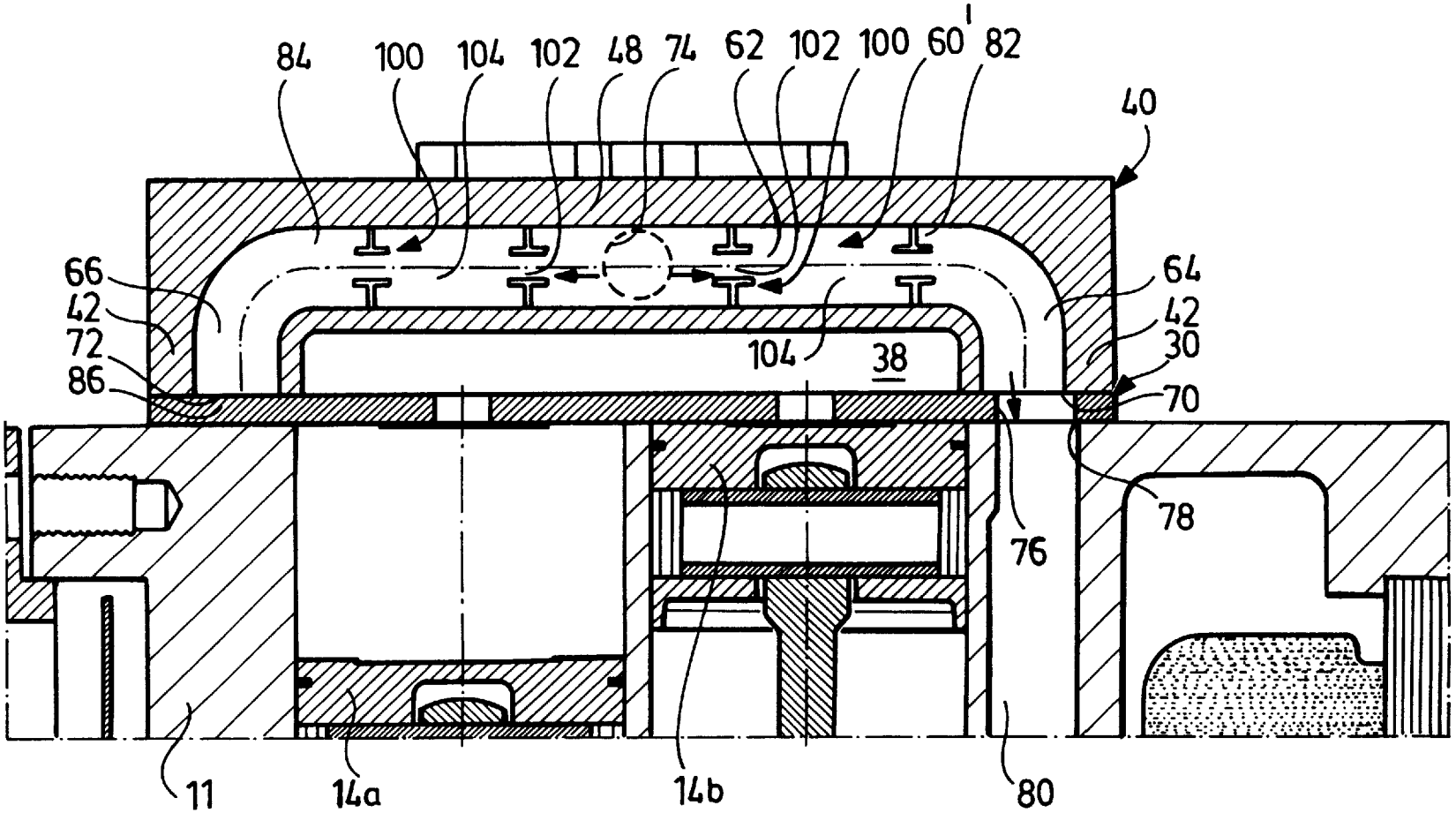
FIG. 6 is a section similar to FIG. 4 through a second embodiment of an inventive refrigerant compressor.

In a second embodiment, shown in FIG. 6, those parts which are identical to those of the first embodiment are given the same reference numerals. Reference is therefore to be had in full to the statements on the first embodiment for a description of these.

In contrast to the first embodiment in which the muffler channel 60 has a constant cross section over its entire length, provision is made in the second embodiment for screens 100 to be inserted in the muffler channel 60', which allow the cross section of the muffler channel 60' to be varied such that sections 102 of reduced cross section of the muffler channel 60' and sections 104 of expanded cross section of the muffler channel 60' follow one another and the attenuation effect can thus be further increased.

In particular, in both section 82 through which the refrigerant flows and section 84 which is closed off in an acoustically blind manner, the sections 102 of reduced cross section and the sections 104 of expanded cross section are preferably arranged symmetrically in relation to the inlet opening 74.

Aside from that, the second embodiment is of the same design as the first embodiment, so that identical parts are given identical reference numerals and reference is thus to be had in full to the description of these in conjunction with the first embodiment.

What is claimed is:

1. Refrigerant compressor comprising a compressor housing, at least one cylinder chamber arranged in the compressor housing, a piston oscillatingly movable in the cylinder chamber, a suction chamber which is arranged upstream from the cylinder chamber and from which refrigerant enters the cylinder chamber, a pressure chamber which is arranged downstream from the cylinder chamber and into which refrigerant compressed in the cylinder chamber enters, a muffler channel which extends between a first end and a second end and via which compressed refrigerant flows from the pressure chamber into the outlet channel, the muffler channel comprising an inlet opening located between the first end and the second end.

2. Refrigerant compressor in accordance with claim 1, wherein the outlet opening is located in the area of one of the ends.

3. Refrigerant compressor in accordance with claim 1, wherein the muffler channel comprises two orifices in addition to the inlet opening, and wherein at least one of the orifices forms the outlet opening.

4. Refrigerant compressor in accordance with claim 3, wherein the two orifices are arranged in the area of opposite ends.

5. Refrigerant compressor in accordance with claim 1, wherein the muffler channel extending between the two ends comprises a section through which the compressed refrigerant flows, and a section which is closed off in an acoustically blind manner.

6. Refrigerant compressor in accordance with claim 5, wherein the section of the muffler channel through which the refrigerant flows and the section of the muffler channel which is closed off in an acoustically blind manner extend away from the inlet opening.

7. Refrigerant compressor in accordance with claim 5, wherein the section through which the refrigerant flows and the section which is closed off in an acoustically blind manner extend away from the inlet opening in opposite directions.

8. Refrigerant compressor in accordance with claim 1, wherein the inlet opening is located in the area of a central section of the muffler channel.

9. Refrigerant compressor in accordance with claim 1, wherein the muffler channel is arranged in a part which is mountable on the compressor housing, and wherein the part is mountable on the compressor housing in such a way that either the orifice arranged at the first end or the orifice arranged at the second end serves as outlet opening and leads into the outlet channel provided.

10. Refrigerant compressor in accordance with claim 9, wherein the respective outlet opening which does not open into the outlet channel is closed off in an acoustically blind manner.

11. Refrigerant compressor in accordance with claim 10, wherein the orifice closed off in an acoustically blind manner is closed by an area of that part which carries the part mountable on the compressor housing.

12. Refrigerant compressor in accordance with claim 1, wherein the muffler channel extends in the cylinder head.

13. Refrigerant compressor in accordance with claim 12, wherein the muffler channel is formed in the cylinder head.

14. Refrigerant compressor in accordance with claim 1, wherein the muffler channel extends with one section thereof in a surface lying approximately parallel to a cylinder head cover of the cylinder head.

15. Refrigerant compressor in accordance with claim 14, wherein the muffler channel extends with a substantial section thereof in the direction of a crankshaft.

16. Refrigerant compressor in accordance with claim 1, wherein the muffler channel extends on a side of the pressure chamber facing away from the cylinder chambers.

17. Refrigerant compressor in accordance with claim 16, wherein the muffler channel comprises end areas extending in the direction of a crankcase.

18. Refrigerant compressor in accordance with claim 17, wherein the orifices face the crankcase.

19. Refrigerant compressor in accordance with claim 17, wherein the orifices of the muffler channel lie in a bearing surface of the cylinder head.

20. Refrigerant compressor in accordance with claim 1, wherein the muffler channel has cross-sectional constrictions and cross-sectional expansions.

21. Refrigerant compressor comprising a compressor housing, at least one cylinder chamber arranged in the compressor housing, a piston oscillatingly movable in the cylinder chamber, a suction chamber which is arranged upstream from the cylinder chamber and from which refrigerant enters the cylinder chamber, a pressure chamber which is arranged downstream from the cylinder chamber and into which refrigerant compressed in the cylinder chamber enters, a muffler channel which extends between a first end and a second end and via which compressed refrigerant flows from the pressure chamber into the outlet channel, the muffler channel extending between the two ends comprising a section through which the compressed refrigerant flows, and a section which is closed off in an acoustically blind manner.

* * * * *